US009903067B2

(12) United States Patent
Ryoo et al.

(10) Patent No.: US 9,903,067 B2
(45) Date of Patent: Feb. 27, 2018

(54) LAUNDRY MACHINE

(71) Applicant: LG ELECTRONICS INC., Seoul (KR)

(72) Inventors: Byeongjo Ryoo, Seoul (KR); Hyojun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 69 days.

(21) Appl. No.: 14/889,000

(22) PCT Filed: Jul. 29, 2014

(86) PCT No.: PCT/KR2014/006936
§ 371 (c)(1),
(2) Date: Nov. 4, 2015

(87) PCT Pub. No.: WO2015/068934
PCT Pub. Date: May 14, 2015

(65) Prior Publication Data

US 2016/0083896 A1 Mar. 24, 2016

(30) Foreign Application Priority Data

Nov. 11, 2013 (KR) ..... 10-2013-0136079

(51) Int. Cl.
*D06F 25/00* (2006.01)
*D06F 58/20* (2006.01)
(Continued)

(52) U.S. Cl.
CPC ..... *D06F 58/24* (2013.01); *D06F 25/00* (2013.01); *D06F 58/206* (2013.01);
(Continued)

(58) Field of Classification Search
CPC ..... D06F 25/00; D06F 58/206; D06F 58/24
See application file for complete search history.

(56) References Cited

U.S. PATENT DOCUMENTS

2010/0077787 A1* 4/2010 Masuda ..... D06F 58/206 62/324.5
2011/0265523 A1* 11/2011 Bison ..... D06F 25/00 68/20
(Continued)

FOREIGN PATENT DOCUMENTS

DE 44 09 607 A1 10/1994
DE 196 42 165 A1 4/1998
(Continued)

OTHER PUBLICATIONS

International Search Report dated Dec. 9, 2014 issued in Application No. PCT/KR2014/006936.

*Primary Examiner* — Joseph L Perrin
(74) *Attorney, Agent, or Firm* — KED & Associates LLP

(57) ABSTRACT

A laundry machine (100) is disclosed. The laundry machine (100) includes a tub (120), an air supply unit (160) configured to circulate air in the tub (120), a heat pump including a compressor (165), an evaporator (220), an expansion valve, and a condenser (240), the heat pump being configured to dehumidify and heat the air from the air supply unit (160), and a cooling unit (300, 400, 500) installed at the compressor (165) to cool the compressor (165) using a supplied fluid.

15 Claims, 7 Drawing Sheets

(51) Int. Cl.

| | |
|---|---|
| ***D06F 58/24*** | (2006.01) |
| *D06F 39/08* | (2006.01) |
| *D06F 58/22* | (2006.01) |
| *D06F 58/26* | (2006.01) |

(52) U.S. Cl.
CPC ..... *D06F 39/088* (2013.01); *D06F 58/22* (2013.01); *D06F 58/263* (2013.01)

(56) References Cited

U.S. PATENT DOCUMENTS

| | | | | |
|---|---|---|---|---|
| 2012/0055178 | A1* | 3/2012 | Takahashi | F24H 9/2007 62/79 |
| 2012/0186305 | A1* | 7/2012 | Taniguchi | D06F 25/00 68/19 |
| 2012/0246960 | A1* | 10/2012 | Lee | D06F 58/206 34/86 |
| 2014/0338218 | A1* | 11/2014 | Contarini | D06F 39/02 34/493 |

FOREIGN PATENT DOCUMENTS

| | | | |
|---|---|---|---|
| EP | 2 599 912 | A1 | 6/2013 |
| WO | WO 2012/134148 | A2 | 10/2012 |

* cited by examiner

[Fig. 1]
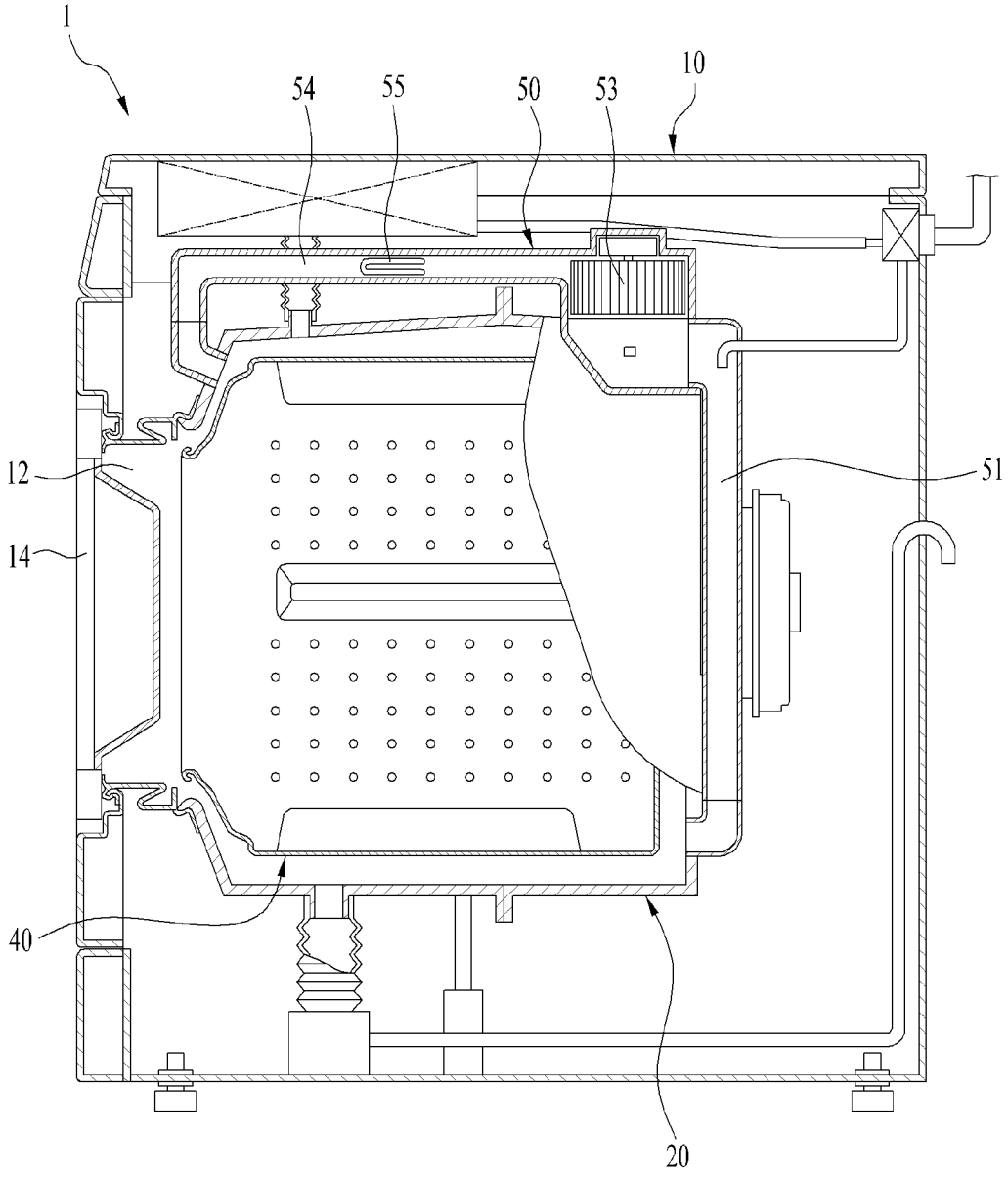

[Fig. 2]
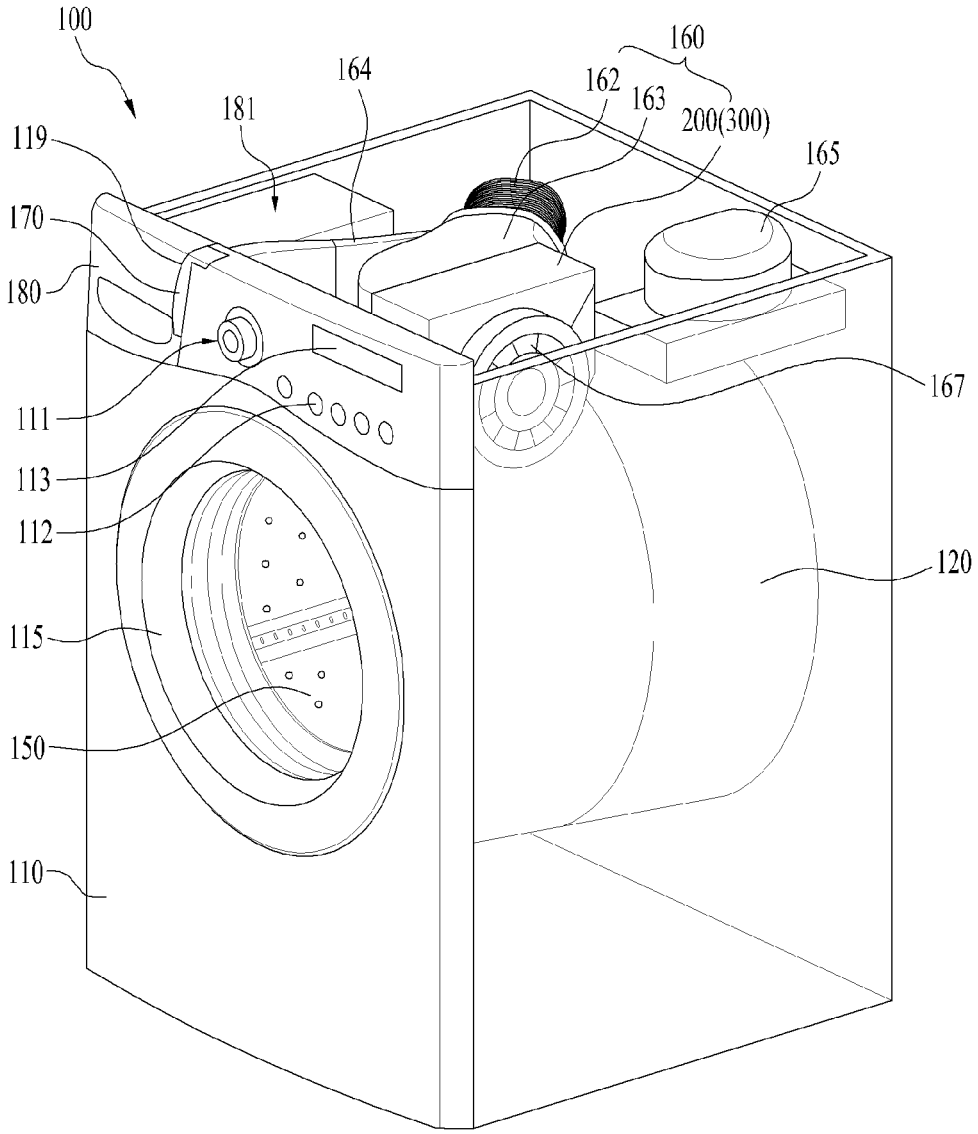

[Fig. 3]
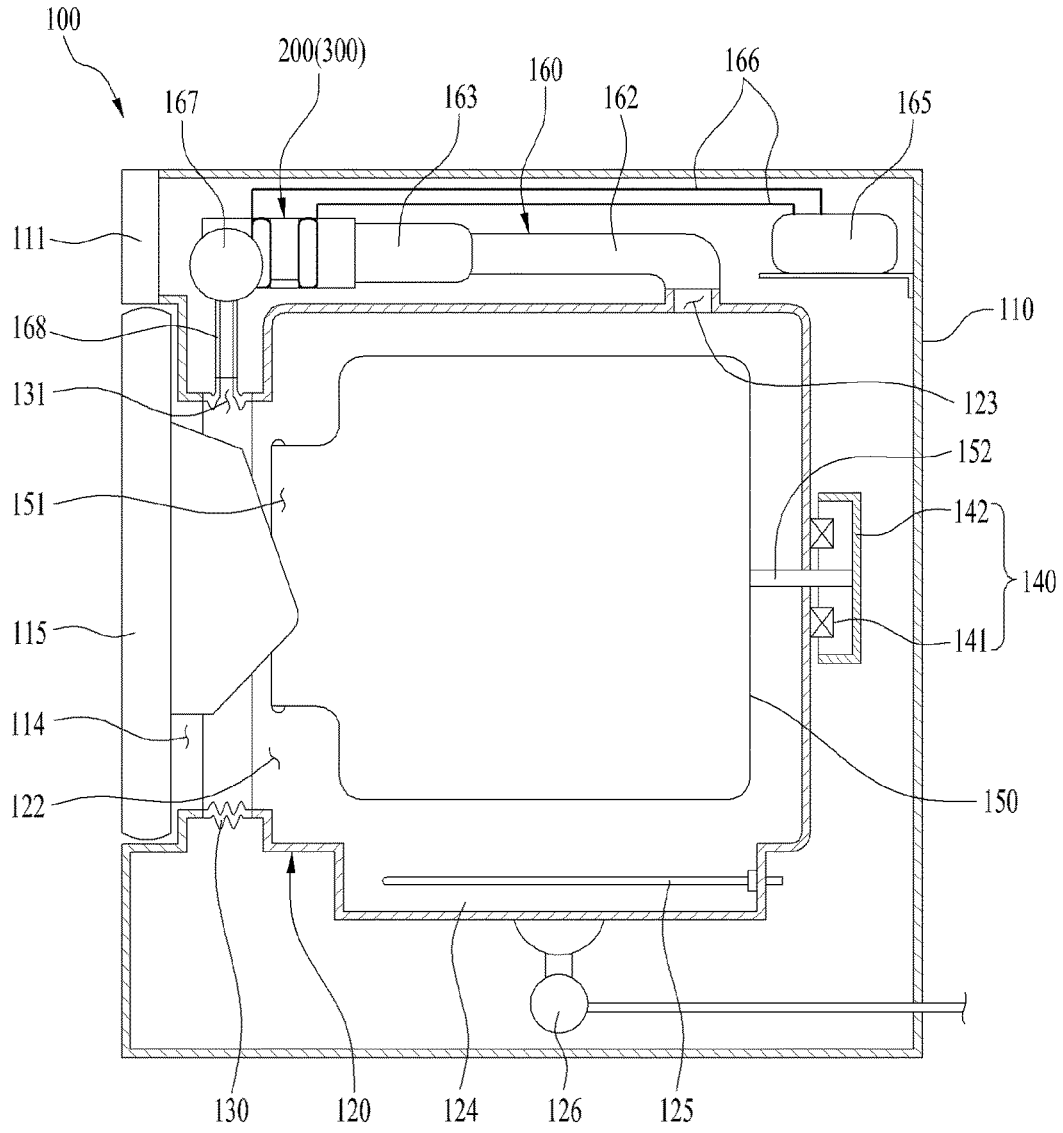

[Fig. 4]
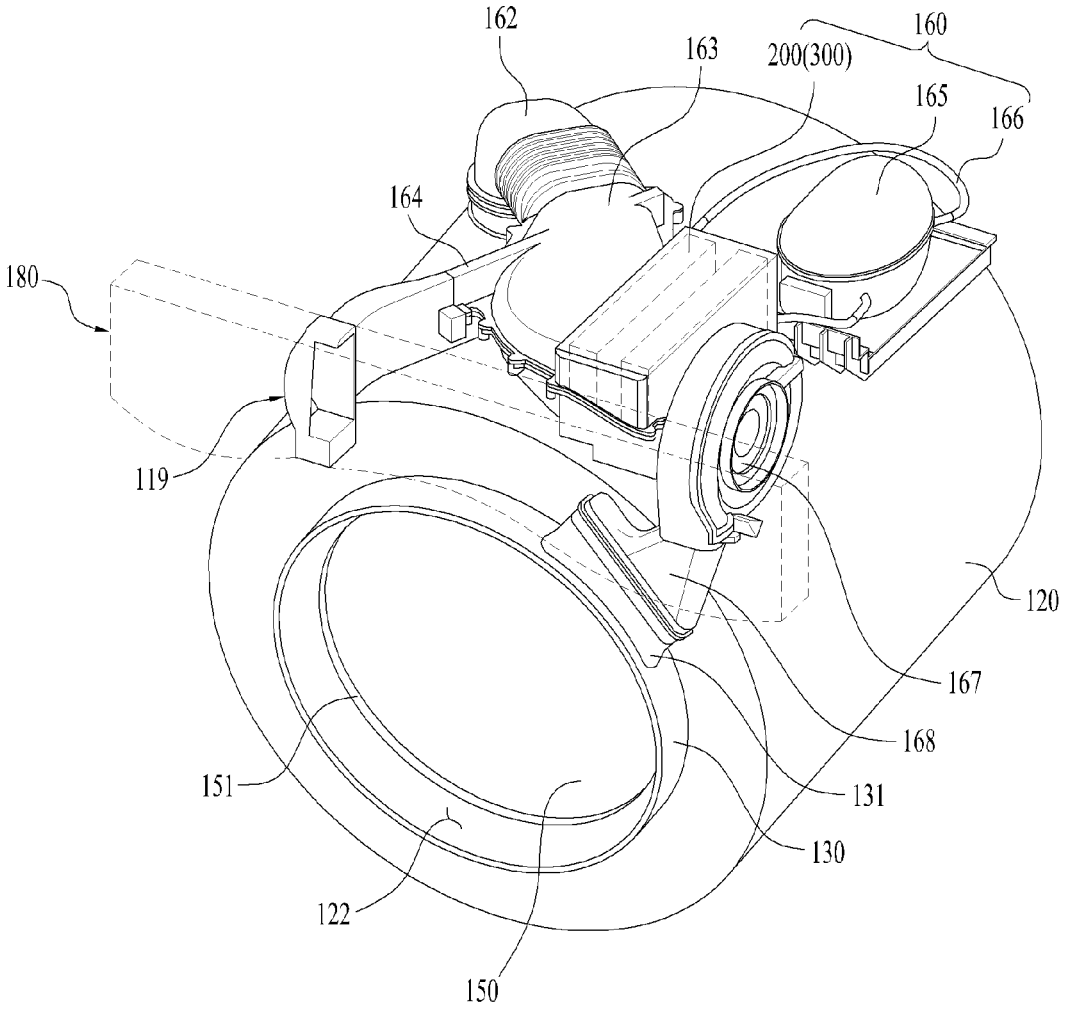

[Fig. 5]
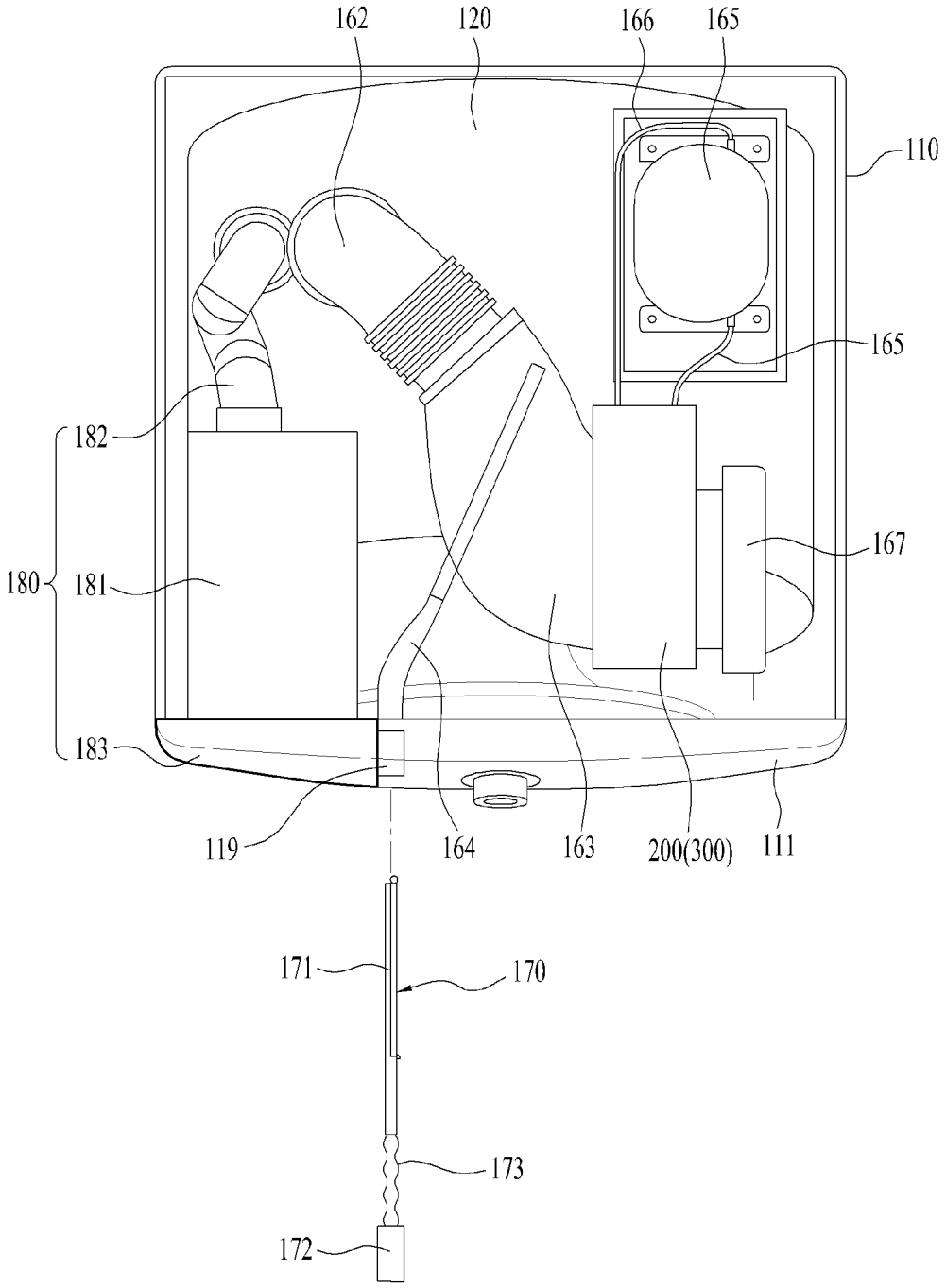

[Fig. 6]
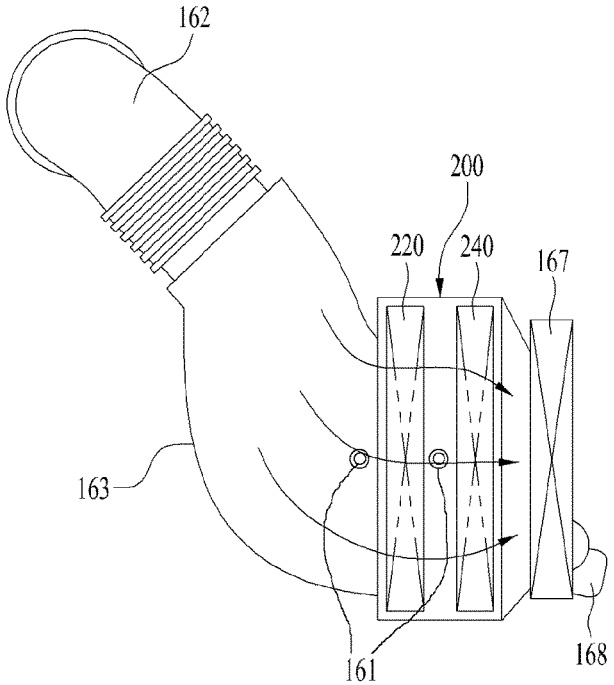
[Fig. 7]
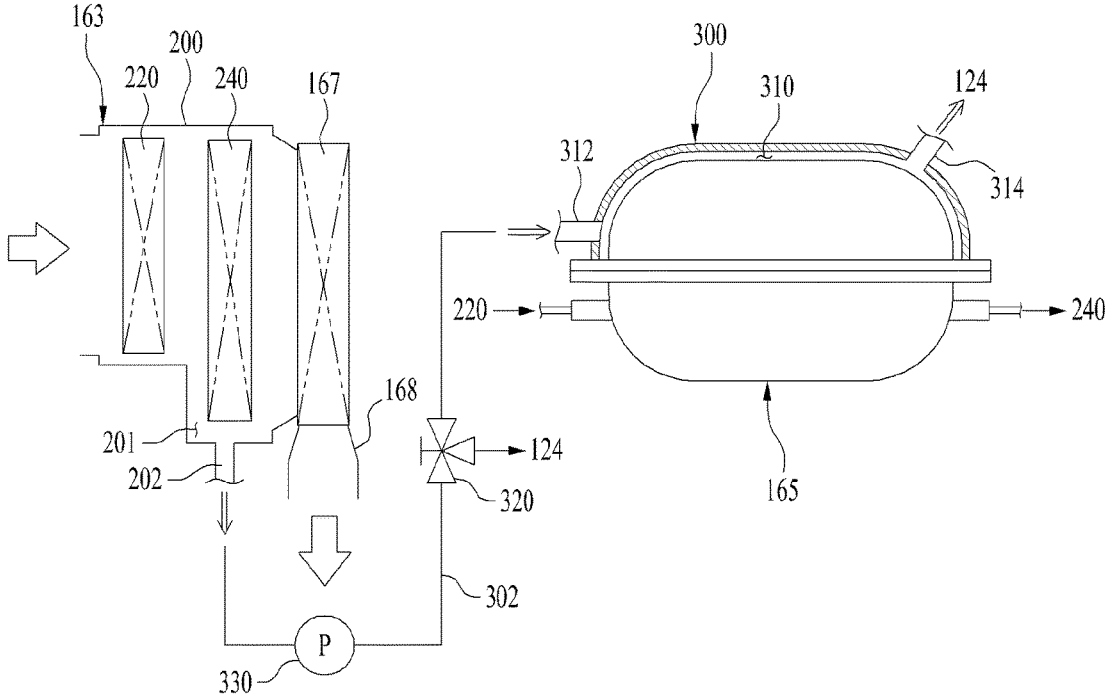

[Fig. 8]
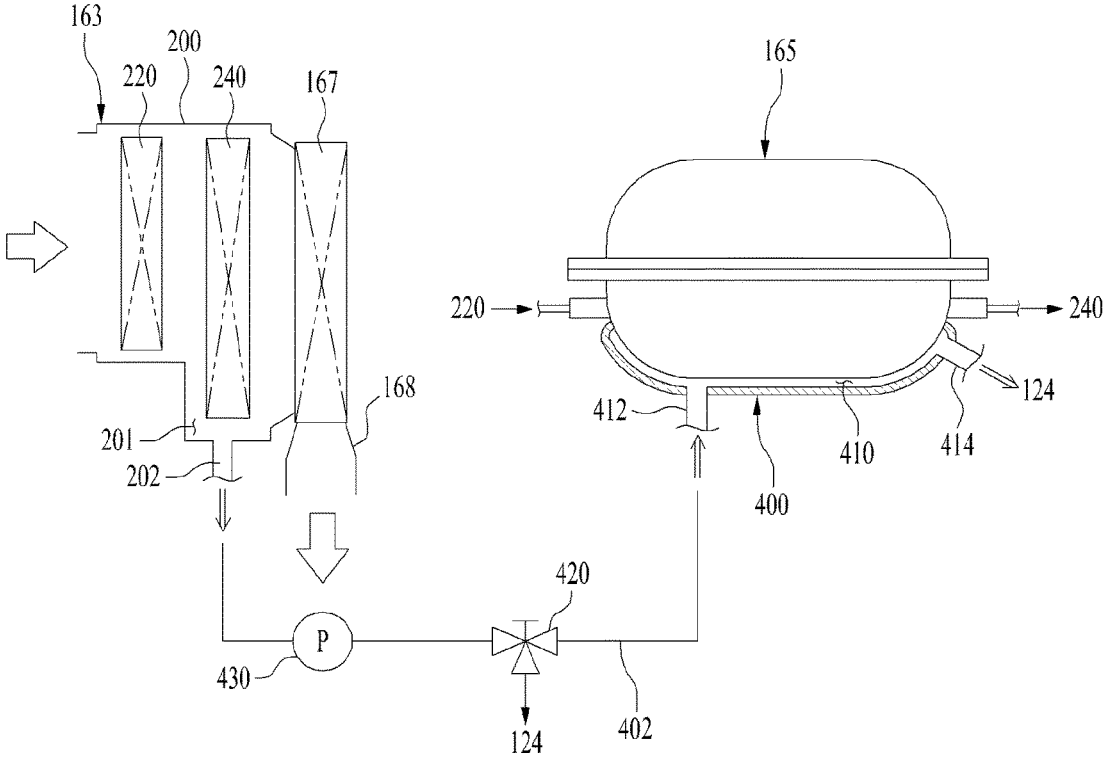
[Fig. 9]
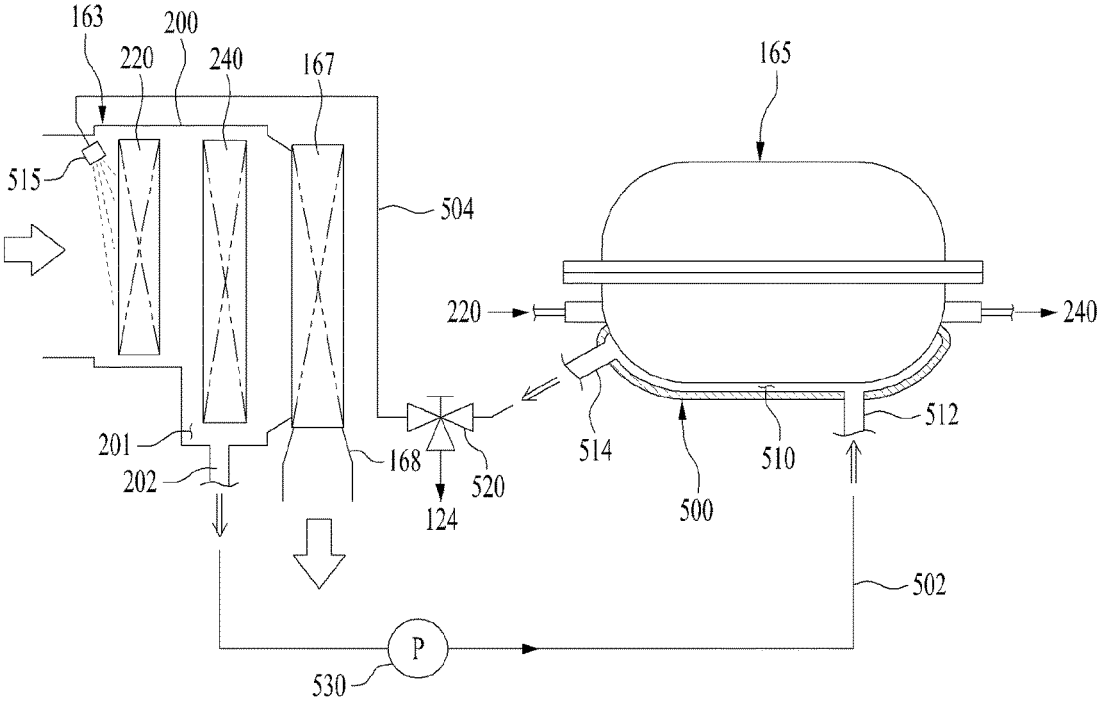

LAUNDRY MACHINE

CROSS-REFERENCE TO RELATED PATENT APPLICATIONS

This application is a U.S. National Stage Application under 35 U.S.C. § 371 of PCT Application No. PCT/KR2014/006936, filed Jul. 29, 2014, which claims priority to Korean Patent Application No. 10-2013-0136079, filed Nov. 11, 2013, whose entire disclosures are hereby incorporated by reference.

TECHNICAL FIELD

The present invention relates to a laundry machine. More specifically, the present invention relates to a laundry machine which is provided with a heat pump and is capable of preventing the heat pump from overheating.

BACKGROUND ART

Examples of laundry machines generally includes a washing machine having only a washing function of washing clothing, and a machine having both washing and drying functions. The washing machine having only a washing function is a product that removes various contaminants from clothing and bedding using the softening effect of a detergent, friction of water streams and shock applied to the laundry to according to rotation of a pulsator or a drum. A recently introduced automatic washing machine automatically performs a series of operations including a washing operation, a rinsing operation and a spin-drying operation, without requiring user intervention.

The laundry machine capable of drying clothes is a type of laundry machines that has not only the function of the washing machine dedicated to washing but also the function of drying the laundry after washing.

Laundry machines capable of drying laundry supply high-temperature air (hot air) to the laundry, and can be classified into an exhaust type and a circulation (or condensation) type depending on how air flows through the machine.

The exhaust type laundry machine supplies heated air to the laundry accommodating part, but discharges the air coming out of the laundry accommodating part from the laundry machine instead of circulating the air.

The circulation type laundry machine circulates air in a laundry accommodating part storing the laundry by removing moisture from the air (i.e., dehumidifying the air) discharged from the laundry accommodating part, heating the air, and then resupplying the air to the accommodation part.

Hereinafter, a conventional circulation type laundry machine having the drying function will be briefly described with reference to FIG. 1. As shown in FIG. 1, the circulation type laundry machine 1 having the drying function 1 includes a cabinet 10 provided with an introduction port 12 defining an accommodation space therein and allowing laundry to be introduced therethrough and an a door 14 to open and close the introduction port 12, a tub 20 to accommodate the cabinet 10, a drum 40 rotatably installed in the tub 20 to accommodate laundry to be dried, and an air supply unit 50 to supply the drying air to the tub 20 to dry the laundry.

Herein, the air supply unit 50 includes a condensation duct 51 formed at the exterior of the tub 20 to condense the air containing moisture produced in the tube 20, a heating duct 54 connected to the downstream side of the condensation duct 51 in the flow direction of the air to heat the air through a heater 56 and to supply the heated air into the tub, and an air-blowing fan 53 causing the air in the tub 20 to circulate along the condensation duct 51 and the heating duct 54.

In drying the laundry in the laundry machine 1 configured as above, the air moved by the air-blowing fan 53 is heated by the heater 56 provided to the heating duct 54, and the heated air is supplied into the tub 20. Thereby, the laundry is dried by rotation of the drum 40 and the hot air. Thereafter, the heated air having dried the laundry changes to humid air as the laundry is dried. The humid air flows from the tub 20 into the condensation duct 51, and the moisture is removed from the air in the condensation duct 51.

Herein, separate cooling water is supplied to the condensation duct 51 to condense the humid air. The air introduced into the condensation duct 51 is supplied back to the heating duct 54 by the air-blowing fan 53, thereby circulating through the process described above.

The condensation duct 51 is formed in the shape of a pipe in consideration of the volumetric capacity of the air-blowing fan 53 and smooth air flow, and the inner surface of the condensation duct 51 condenses moisture contained in the humid air through exchange of heat with the humid air to remove the moisture from the air. To condense the moisture in the humid air introduced into the condensation duct 51, a large amount of cooling water needs to be consistently supplied during the laundry drying process.

Meanwhile, the air supply unit 50 provided to the conventional laundry machine having the function of drying includes an air-blowing fan 53 to discharge the air from the laundry accommodating part and a heating duct 54 to heat the air caused to flow by the air-blowing fan 53.

That is, in the conventional laundry machine 1, the air-blowing fan 53 is positioned before the heating duct 54 with respect to the air flow direction, and thus the air flowing out of the laundry accommodation part (i.e., the tub 20) sequentially passes through the air-blowing fan 53 and heating duct 54, and is then supplied back to the laundry accommodation part.

The conventional laundry machine as described above uses a heater which is configured to heat the air to supply high temperature air (hot air) to the laundry.

Such heaters include a gas heater to burn a gas to heat the air and an electric heater to heat the air through electric resistance. Recently, the electric heater is widely used as it is easily installable and has a simple structure.

However, when the air is heated by the electric heater, the high-temperature heat of the heater may be directly transferred to the laundry, damaging the laundry and even leading to fire in the laundry machine.

In addition, since the electric heater heats the air using electricity, heating the air to a desired temperature may consume a large amount of electricity, thereby increasing maintenance expenses.

Moreover, removing moisture from the air having dried the laundry disadvantageously requires injection of a large amount of cooling water into the condensation duct.

In this regard, a laundry machine capable of generating hot air through a heat pump having an evaporator, a compressor, a condenser and an expander through which a refrigerant circulates, and an air blower has recently been developed and is increasingly widely used.

In the case of such laundry machine with a heat pump, the evaporator may remove moisture contained in the air, and the condenser may heat the air and supply and circulate the heated air to the tub to dry the laundry.

That is, a typical heat pump has a circulation cycle in which a refrigerant supplied from the compressor condenses moisture contained in the air and heats the air through heat exchange occurring in the evaporator and the condenser, and then returns to the compressor.

The circulation cycle of the refrigerant may be smoothly implemented by the compressor only when heat exchange consistently occurs in the evaporator and the condenser during the circulation cycle. That is, for the laundry machine having the function of drying and employing a heat pump, it is important to maintain constant heat exchange during operation of the heat pump.

However, when the drying cycle is performed in the laundry machine having the function of drying and employing the heat pump, the heat pump may overheat. That is, at the initial start and final start of the heat pump, heat exchange in the evaporator or the condenser is not balanced with that in the condenser or the evaporator, and thus the discharge pressure of the compressor increases, overloading the compressor.

In this case, the operational temperature of the heat pump excessively increases, and the pressure of the refrigerant discharged from the compressor excessively increase. Thereby, the efficiency of the heat pump may not be normally exhibited.

DISCLOSURE OF INVENTION

Technical Problem

An object of the present invention devised to solve the problem lies in a laundry machine provided with an air supply unit for supply of heated air for drying of laundry having an improved structure to increase drying efficiency.

Another object of the present invention devised to solve the problem lies in a laundry machine allowing the air moved by an air-blowing fan to pass through the entire area of heat exchange to increase heat exchange efficiency.

Another object of the present invention devised to solve the problem lies in a laundry machine having a heat exchanger with an improved structure provided to a drying duct of an air supply unit to increase heat exchange efficiency of the air passing through the drying duct and to simplify the structure of the heat exchanger.

Another object of the present invention devised to solve the problem lies in a laundry machine that improves the installation position of an air supply unit for supply of heated air to reduce the overall volume of the laundry machine.

A further object of the present invention devised to solve the problem lies in a laundry machine that may prevent temperature of a compressor of a heat pump for heating of the air from rising due to overloading of the compressor so as to maintain a constant efficiency of the heat pump.

Solution to Problem

The object of the present invention can be achieved by providing a laundry machine including a tub, an air supply unit configured to circulate air in the tub, a heat pump including a compressor, an evaporator, an expansion valve, and a condenser, the heat pump being configured to dehumidify and heat the air from the air supply unit, and a cooling unit installed at the compressor to cool the compressor using a supplied fluid.

Preferably, the air supply unit includes a suction duct to suction the air in the tub, a connection duct connected to the inlet duct, the evaporator and condenser of the heat pump being installed at the connection duct, an air-blowing fan connected to the connection duct, and a discharge duct to supply air to the tub.

The air supply unit preferably further includes a heat exchanger provided to a predetermined part of the connection duct, the evaporator and the condenser being installed at the heat exchanger to correspond to a shape of an outer circumferential surface of the tub.

The laundry machine according to claim 3, wherein a lower portion of the heat exchanger is provided with a condensed water sump to collect condensed water produced in the evaporator.

Preferably, the fluid is the condensed water collected in the condensed water sump, and the cooling unit cools the compressor using the condensed water.

The cooling unit preferably includes a supply pipe connected to the condensed water sump, a water jacket allowing the condensed water supplied to the supply pipe to pass therethrough to cool the compressor, and a discharge pipe to discharge the condensed water having passed through the water jacket.

The supply pipe is preferably provided with a condensed water pump to forcibly move the condensed water.

The supply pipe is preferably provided with a 3-way valve to switch a flow passage of the condensed water to the water jacket or the tub.

The heat exchanger is preferably provided with a washing nozzle to wash the evaporator or the condenser, and the discharge pipe supplies the condensed water to the washing nozzle.

The discharge pipe is preferably provided with a 3-way valve to switch a flow passage of the discharge pipe to the washing nozzle or the tub.

Preferably, supply of the condensed water to the washing nozzle and cooling of the compressor are simultaneously performed.

Preferably, the cooling unit is selectively provided to an upper portion or lower portion of the compressor.

The cooling unit is preferably provided to upper and lower portions of the compressor.

The fluid is preferably supplied from a water supply source configured to supply wash water to the tub.

Advantageous Effects of Invention

According to one embodiment of the present invention, a laundry machine using an air supply unit employing a heat pump according to one embodiment of the present invention may have a reduced volume and a compact size.

In addition, in a laundry machine using an air supply unit employing a heat pump according to one embodiment of the present invention, the air supply structure and the air heating structure may be improved.

In addition, in a laundry machine using an air supply unit employing a heat pump according to one embodiment of the present invention, the air movement path in a heat exchanger of the heat pump may be improved, thereby increasing heat exchange efficiency.

In a laundry machine using an air supply unit employing a heat pump according to one embodiment of the present invention, a heat exchanger is integrated with the air supply unit, thereby increasing the heat exchange efficiency of the heat exchanger.

In a laundry machine according to one embodiment of the present invention, when the heat pump overheats during operation, it is directly cooled using cooling water. Therefore, the efficiency of operation of the heat pump may be held constant.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view illustrating a conventional laundry machine;

FIG. 2 is a perspective view illustrating a laundry machine according to the present invention;

FIG. 3 is a cross-sectional view schematically illustrating the laundry machine according to the present invention;

FIG. 4 is a perspective view illustrating main elements of the laundry machine according to the present invention;

FIG. 5 is a plan view illustrating main elements of the laundry machine according to the present invention;

FIG. 6 is a view schematically illustrating an air supply unit of the laundry machine according to the present invention;

FIG. 7 is a view schematically illustrating a cooling structure of a compressor according to a first embodiment of the present invention;

FIG. 8 is a view schematically illustrating a cooling structure of a compressor according to a second embodiment of the present invention; and FIG. 9 is a view schematically illustrating a cooling structure of a compressor according to a third embodiment of the present invention.

BEST MODE FOR CARRYING OUT THE INVENTION

Reference will now be made in detail to the preferred embodiments of the present invention, examples of which are illustrated in the accompanying drawings.

In describing the present invention, terms used herein for the elements are defined based on the functions of the elements. Accordingly, the terms should not be understood as limiting the technical elements. In addition, the terms for respective elements may be replaced with other terms used in the art.

Meanwhile, the construction and control method of an apparatus described below are simply illustrative of embodiments of the present invention, and are not intended to limit the scope of the present invention. Wherever possible, the same reference numbers will be used throughout the drawings to refer to the same or like parts.

In addition, the laundry mentioned in this specification includes not only clothes and costumes, but also objects such as shoes, socks, gloves, and hats which a person can wear. The laundry may treat all objects which can be washed.

Reference will now be made in detail to the preferred embodiments of the present invention, examples of which are illustrated in the accompanying drawings. FIG. 2 is a perspective view illustrating a laundry machine according to the present invention, and FIG. 3 is a cross-sectional view schematically illustrating the internal structure of the laundry machine according to the present invention.

As shown in FIGS. 2 and 3, the laundry machine 100 includes a cabinet 1 defining an external appearance of the laundry machine 100, a laundry accommodation part provided in the cabinet 110 to store laundry, and an air supply unit 160 to supply hot air to the laundry accommodation part.

The cabinet 110 includes an introduction port 114 for introduction of laundry and a door 115 rotatably provided to the cabinet 110 to open and close the introduction port 114. Provided to the upper portion of the introduction port 114 are a control panel 111 including at least one of an input unit 112 for input of a control command for operation of the laundry machine 100 and a display unit 113 to display details of control of the laundry machine, and a controller (not shown) to control the above constituent parts according to the control command input through the input unit 112.

Herein, the input unit 112 provided to the control panel 111 takes the form of a button or a rotary knob, and serves as a means to input, to the controller, control commands such as, for example, a program (a washing course or a drying course) for washing or drying set in the laundry machine, washing time, the amount of wash water, and hot air supply time.

The display unit 113 displays a control command (such as a course name) input through the input unit and information (such as remaining time) generated as the laundry machine 100 operates according to the input control command.

In the case in which the laundry machine 100 is provided as a dryer only for drying of laundry, the laundry accommodation part may be provided only with a drum 150 rotatably provided in the cabinet 110.

On the other hand, in the case in which the laundry machine 100 is provided as an apparatus capable of both washing and drying of the laundry, the laundry accommodation part may include a tub 120 provided in the cabinet to store wash water and a drum 150 rotatably provided in the tub to store the laundry, as shown in FIG. 2.

For simplicity of description, it will be assumed in the following description that the laundry accommodation part is provided with both the tub 120 and the drum 150.

As shown in FIG. 3, the tub 120 has the shape of a hollow cylinder and is supported on or fixed to the interior of the cabinet 110 by a separate suspension (not shown). In addition, the front of the tub 120 is provided with a tub opening 122 for introduction and retrieval of laundry at a position corresponding to the position of the introduction port 114 of the cabinet 110.

Herein, a gasket 130 is provided between the tub opening 122 and the introduction port 114. The gasket 130 not only serves to prevent the wash water stored in the tub 120 from leaking from the tub 120, but also serves to prevent vibration generated in the tub 120 during rotation of the drum 150 from being transferred to the cabinet 110. Accordingly, the gasket 130 may be provided with a vibration isolation material such as rubber.

Meanwhile, the tub 120 may be arranged parallel with the ground by which the cabinet 110 is supported as shown in FIG. 3, or may be inclined at a predetermined angle with respect to the ground. In the case in which the tub 120 is inclined at a predetermined angle with respect to the ground, the inclination angle of the tub 120 is preferably less than 90 degrees.

Herein, the upper circumferential portion of the tub 120 is provided with an air discharge hole 123 for discharge of air from the tub 120, and the lower portion of the tub 120 is provided with a drainage sump 124 for draining wash water stored in the tub 120. Herein, the drainage sump 124 is formed in a recessed shape at the lower portion of the tub 120 to collect the wash water in the tub 120.

A drainage unit 126 to drain the wash water collected in the drainage sump is connected to the outer lower portion of the drainage sump 124. Herein, the drainage unit 126 discharges the wash water collected in the drainage sump using a drainage pipe and a drainage pump.

Meanwhile, the air discharge hole 123 is arranged in the longitudinal direction of the tub 120. Preferably, the air discharge hole 123 is preferably spaced a predetermined distance from a line passing through the center of the tub 120. Herein, the air discharge hole 123 is positioned so as to facilitate discharge of air from the tub 120 through the air discharge hole 123 when the drum 150 rotates.

The drum 150, which has the shape of a hollow cylinder, is positioned in the tub 120 and is rotated in the tub 120 by a motor 140 provided to the exterior of the tub 120.

Herein, the motor 140 may include a stator 141 fixed to the rear surface of the tub 120, a rotor 142 to rotate through electromagnetic interaction with the stator 141, and a rotating shaft 152 connecting the rear surface of the drum 150 and the rotor 142 by penetrating the rear surface of the tub 120.

The drum 150 is provided with a drum opening 151 communicating with the introduction port 114 and the tub opening 122, and accordingly the user can introduce laundry into the drum 150 through the introduction port 114 or take the laundry stored in the drum 150 out of the cabinet 110.

In the case in which the laundry machine 100 is capable of both washing and drying laundry, the interior of the cabinet 110 may be further provided with a detergent supply unit 180 to store a detergent to be supplied to the tub 120.

The detergent supply unit 180 may include a storage unit 181 (see FIG. 5) provided in the form of a drawer withdrawable from the cabinet 110, a detergent supply pipe 182 (see FIG. 5) to guide the detergent stored in the storage unit 181 into the tub 120, and a storage unit handle 183 positioned at one side of the control panel 111 to allow the user to withdraw the storage unit 181 from the cabinet 110.

The storage unit 181 receives water from a water supply source (not shown) arranged outside of the laundry machine 100. When water is supplied to the storage unit 181 through the water supply source, the detergent in the storage unit 181 and water are supplied together to the tub 120 through the detergent supply pipe 182.

The air supply unit 160 includes, as shown in FIG. 4, circulation flow passages 162, 163 and 168 to guide air discharged from the tub 120 to the front surface of the tub 120 (i.e., one surface of the tub formed on the side where the introduction port 114 is positioned), an air supply unit 160 provided in the circulation flow passages 162, 163 and 168, and an air-blowing fan 167 to circulate the air in the tub 120.

The circulation flow passages 162, 163 and 168 may be arranged such that the air discharged from the back of the tub 120 moves into the tub 120 through the front surfaced of the tub 120. FIG. 4 shows an example of the circulation flow passages 162, 163 and 168 allowing the air to be withdrawn from the upper rear portion of the circumferential surface of the tub 120 and to be discharged into the tub 120 through the upper front portion of the circumferential surface of the tub 120.

The circulation flow passages 162, 163 and 168 may include a suction duct 162 fixed to the air discharge hole 123 provided to the tub 120, a connection duct 163 connecting the suction duct 162 with the air-blowing fan 167 and allowing the air supply unit 160 to be fixed thereto, and a discharge duct 168 connecting the air-blowing fan 167 with the gasket 130. The circulation flow passages 162, 163 and 168 may be diagonally arranged with respect to the upper surface of the tub 120.

The suction duct 162 is a flow passage into which the air in the tub 120 is withdrawn through the air discharge hole 123 positioned at the rear portion of the circumferential surface of the tub 120. Preferably, the suction duct 162 is formed of a vibration isolation member (such as rubber, not shown). The vibration isolation member serves to prevent vibration transferred to the tub 120 during rotation of the drum 150 from being transferred to the connection duct 163 and the air supply unit 160 through the suction duct 162.

To more efficiently prevent the vibration transferred to the tub 120 from being transferred to the connection duct 163 and the air supply unit 160, the suction duct 162 may further be provided with a bellows. Herein, the bellows may be provided to the entire section of the suction duct 162, or may be provided to only a portion of the section of the suction duct 162 (e.g., a portion coupled to the connection duct 163).

The discharge duct 168 serves to guide the air discharged from the connection duct 163 through the air-blowing fan 167 into the tub 120. One end of the discharge duct 168 is fixed to the air-blowing fan 167, and the other end thereof is connected to a duct connection hole 131 provided to the gasket 130.

To prevent vibration transferred to the tub 120 from being transferred to the air-blowing fan 167 or the connection duct 163 through the discharge duct 168 during rotation of the drum 150, at least one of the gasket 130 and the discharge duct 168 is preferably formed of a vibration isolation member (or an elastic member).

Meanwhile, since the air-blowing fan 167 is provided between the air supply unit 160 and the discharge duct 168, the air-blowing fan 167 allows the air to pass through the air supply unit 160 by generating negative pressure at the back of the air supply unit 160 rather than generating positive pressure at the front of the air supply unit 160.

In the case in which the air-blowing fan 167 allows the air to pass through the air supply unit 160 by generating positive pressure at the front of the air supply unit 160, part of the air in the connection duct 163 may easily move to the air supply unit 160, but the other part of the air may not easily move to the air supply unit 160.

That is, most of the air discharged from the air-blowing fan 167 readily moves toward the air supply unit 160, but a part of the air discharged from the air-blowing fan 167 may not rapidly move to the air supply unit 160 depending on the shape of the connection duct 163 or the structure of the air-blowing fan.

Therefore, in the case of positioning the air-blowing fan 167 before the air supply unit 160 to forcibly move the air toward the air supply unit 160 (i.e., to create positive pressure at the front of the air supply unit 160), the amount of air passing through a cross section of the connection duct 163 may vary depending upon the position of the connection duct 163, and accordingly the heat exchange efficiency may be lowered.

On the contrary, the air-blowing fan 167 provided to the laundry machine 100 according to this embodiment is positioned between the air supply unit 160 and the discharge duct 168 connected to the front surface of the tub (namely, the air sequentially passes through the air supply unit 160 and the air-blowing fan 167), and therefore the aforementioned problem may be addressed.

As such, in the air supply unit 160 of the present invention, the air-blowing fan is positioned between the air supply unit 160 and the discharge duct 168 to generate negative pressure at the back of the air supply unit 160, as shown in FIG. 6.

That is, when the negative pressure is generated at the back of the air supply unit 160, the amount of air moving to the air supply unit 160 along the connection duct 163 is held constant at all cross sections of the connection duct 163. Thereby, the efficiency of heat exchange between air and the air supply unit 160 is higher than in the case of positioning the air-blowing fan 167 at the front end of the air supply unit 160, and thus the drying efficiency of the laundry machine may be increased.

Meanwhile, the air supply unit 160 may be provided to heat air through the heat pump to supply the heated air. The heat pump further includes a heat exchanger 200 (including a condenser 240 and an evaporator 220) to exchange heat with moving air and a compressor 165 to supply a refrigerant to the heat exchanger 200. Herein, the compressor 165 is provided with cooling units 300, 400 and 500 to cool the compressor 165 when the compressor 165 is overheated or overloaded.

Herein, the heat exchanger 200 (including the condenser 240 and the evaporator 220) is positioned between the connection duct 163 and the air-blowing fan 167 and inside the connection duct 163, and the compressor 165 of the heat pump is provided to the exterior of the connection duct 163. Such heat pump dehumidifies and heats the air through heat exchange between the air and a refrigerant driven by the compressor 165 to circulate along the condenser 240, an expansion valve, and the evaporator 220.

The heat exchanger 200 of the connection duct 163 that is provided with the evaporator 220 and the condenser 240 is positioned at the upper portion of the circumferential surface of the tub 120, while the evaporator 220 and the condenser 240 are disposed in the heat exchanger 200 such that the evaporator 220 and the condenser 240 are parallel with the axial direction of the tub 120.

Accordingly, the space in which the evaporator 220 is positioned may have a different size than the space in which the condenser 240 is positioned due to a difference between the portions of the circumferential surface of the tub 120. That is, the position of a portion of the heat exchanger 200 to which the evaporator 220 is fixed may be lower than the position of another portion of the heat exchanger 200 to which the condenser 240 is fixed.

In the case in which the connection duct 163 formed in the longitudinal direction of the tub 120 has a constant width, and there is a difference in height between the spaces in which the evaporator 220 and the condenser 240 are placed, a heat exchange capacity of one of the evaporator 220 and the condenser 240 may limit the heat exchange capacity of the other one of the evaporator 220 and the condenser 240. To prevent this problem, an area ratio between the evaporator 220 and the condenser 240 is preferably between 1:1.3 and 1:1.6.

Meanwhile, as the air-blowing fan 167 of the air supply unit 160 operates with operation of the heat pump, the air in the tub 120 circulates through the circulation flow passage (including the suction duct 162, the connection duct 163, the air supply unit 160 and the discharge duct 168).

Herein, the refrigerant is compressed in the compressor 165 and supplied to the condenser 240 of the air supply unit 160, thereby heating the circulating air. After passing through the condenser 240, the refrigerant moves to the evaporator 220 and removes moisture from the air in the evaporator 220.

Herein, in the movement path of the air, the evaporator 220 is positioned before the condenser 240. Accordingly, in the movement path of the air circulating along the tub 120 and the air supply unit 160, the moisture of the air suctioned from the tub 120 is first removed in the evaporator 220, and the dehumidified air is heated during movement through the condenser 240 and is then supplied back to the tub 120.

If condensed water produced in the evaporator 220 remains in the connection duct 163, it may corrode constituents in the connection duct 163 or the heat exchanger 200, or may be mixed with the moving air and supplied to the laundry subjected to the drying operation. Accordingly, provided to the lower portion of the heat exchanger 200 are a condensed water sump 201 to collect and drain the condensed water produced in the evaporator 220 and a drainage pipe 202 connected to the lower portion of the condensed water sump 201 to guide the condensed water collected in the condensed water sump 201.

Herein, the drainage pipe 202 is connected to the drainage sump 124 of the tub 120 or the cooling units 300, 400 and 500 configured to cool the compressor 165. The condensed water collected in the condensed water sump 201 may be moved to the tub 120 through the drainage pipe 202 and drained through the drainage unit 126 of the tub 120, or may be supplied to the cooling units 300, 400 and 500 through the drainage pipe 202 to be used as a refrigerant to cool the compressor 165. A detailed description of the cooling units 300, 400 and 500 will be given later with reference to the drawings.

Meanwhile, a separate temperature sensor 161 configured to sense temperature of the air having passed through the heat exchanger 200 may be provided inside the heat exchanger 200. Herein, the temperature sensor 161 is preferably provided to the front end or rear end of the evaporator 220 provided to the heat exchanger. The internal temperature of the air supply unit 160 and dryness of the laundry subjected to the drying operation may be sensed through sensing of temperature by the temperature sensor 161.

Preferably, the compressor 165 is positioned in a space defined between the circulation flow passages 162, 163 and 168 and the cabinet 110 at the upper portion of the tub 120. That is, since the circulation flow passages 162, 163 and 168 extend diagonally with respect to the upper surface of the tub 120, and therefore the compressor 165 is preferably installed in the space between one side of the circulation flow passages 162, 163 and 168 and the cabinet to prevent the compressor 165 from overlapping the circulation flow passages 162, 163 and 168.

The compressor 165 is provided with cooling units 300, 400 and 500 to cool the compressor in the case of overloading or overheating of the compressor. Herein, the cooling units 300, 400 and 500 may directly cool the compressor 165 by contacting the upper surface or lower surface of the compressor 165, or indirectly cool the compressor 165. The cooling units 300, 400 and 500 will be described in detail with reference to the drawings after description of the air supply unit 160.

The air supply unit 160 may further include a filter unit 170 configured to filter the air to prevent accumulation of foreign substances such as lint in the air supply unit 160.

As shown in FIGS. 4 and 5, the filter unit 170 is preferably detachably attached to the connection duct 163 through the cabinet 110. To this end, the connection duct 163 is provided with a filter guide 164 to guide movement of the filter unit 170. The cabinet 110 may be provided with a filter mounting hole (not shown) allowing the filter unit 170 to pass therethrough.

In the case in which the laundry machine 100 is not provided with the detergent supply unit 180, a filter mounting part 119 may be arranged to pass through the cabinet 110 or the control panel 111.

In the case in which the laundry machine 100 is not provided with the detergent supply unit 180, the filter mounting part 119 may be positioned in a space between the detergent supply unit 180 (which is preferably positioned to be parallel with the control panel 111) and the control panel 111 such that it penetrates the cabinet 110.

In addition, the filter mounting part 119 is preferably provided to the upper portion of the laundry machine 100. This configuration allows the user to remove the filter unit 170 from the laundry machine 100 without bending over, contrary to the case in which the filter unit 170 is positioned at the lower portion of the laundry machine 100. Accordingly, this configuration may enhance user convenience.

The filter guide 164 is provided to connect the filter mounting part 119 to the connection duct 163 such that the filter unit 170 inserted into the filter mounting part 119 is positioned between the suction duct 162 and the air supply unit 160.

The filter unit 170 includes a filter frame 171 provided with a filter and a handle 172 for withdrawal/introduction of the filter unit. The filter unit 170 may further include an elastic part provided between the filter frame 171 and the handle 172 and formed of an elastic member or elastic material to allow movement of the filter frame 171 relative to the handle. The elastic part 173 allows the filter frame 171 to be detachably mounted to the connection duct 163 in the case in which the filter mounting part and the connection duct 163 are not arranged parallel to a line perpendicular to the front surface of the cabinet 110.

Hereinafter, a description will be given of the process of drying operation of the laundry machine as discussed above.

Hereinafter, operation of the heat pump during the drying cycle of the laundry machine 100 according to one embodiment of the present invention will be described, and description of the washing cycle, rinsing cycle and spin-drying cycle will be omitted.

When the drying cycle is executed, the controller drives the compressor 165 of the heat pump of the air supply unit to start the drying cycle.

Operation of the heat pump is briefly described below. First, a refrigerant is caused, by the compressor 165 of the heat pump, to circulate along the condenser 240, the expansion valve (not shown), and the evaporator 220. As the air-blowing fan 167 of the air supply unit 160 begins to operate at the same time, the air in the tub 120 circulates through the circulation flow passages (the suction duct 162, the connection duct 163, the air supply unit 160, and the discharge duct 168).

The refrigerant is compressed in the compressor 165 and supplied to the condenser 240 of the air supply unit 160 to heat the circulating air. After passing through the condenser 240, the refrigerant moves to the evaporator 220 and removes moisture from the air in the evaporator 220.

In the movement path of the air, the evaporator 220 is positioned before the condenser 240. Accordingly, in the movement path of the air circulating along the tub 120 and the air supply unit 160, the moisture of the air suctioned from the tub 120 is first removed in the evaporator 220, and the dehumidified air is heated while moving through the condenser 240 and is then supplied back to the tub 120 so as to dry objects in the tub 120.

If the moisture in the air is reduced as the laundry is dried or the circulation flow passage of the air is blocked in the above process, heat exchange in the evaporator 220 and the condenser 240 may be smoothly performed. As the heat exchange is not smoothly performed in the evaporator 220 and the condenser 240, the compressor 165 to circulate the refrigerant may be overloaded.

Herein, the cooling units 300, 400 and 500 is provided to keep the temperature of the compressor 165 constant to prevent overload to the compressor 165 from causing damage to the compressor 165. Hereinafter, a detailed description will be given of the cooling units 300, 400 and 500 and operation thereof according to one embodiment of the present invention with reference to the drawings.

First, a first cooling unit 300 according to a first embodiment will be described. FIG. 7 is a view schematically illustrating a cooling structure of a compressor according to the first embodiment of the present invention.

As shown in FIG. 7, the first cooling unit 300 according to the first embodiment is provided with a first water jacket 310 defining, on the upper surface of the compressor, a space allowing a fluid (specifically, condensed water produced in the evaporator of the heat exchanger, which is hereinafter simply referred to as 'condensed water') to flow therethrough such that the compressor 165 is cooled by the supplied condensed water.

The first water jacket 310 includes a first water inlet 312 connected to the condensed water sump 201 of the heat exchanger 200 to receive the condensed water collected in the condensed water sump 201 and a first water outlet 314 to discharge the condensed water having cooled the compressor 165 by passing through the first water jacket 310.

Herein, the first water inlet 312 is provided with a first supply pipe 316 connected to the condensed water sump 201 to guide the condensed water collected in the condensed water sump 201 to the first water inlet 312. The first water outlet 314 is provided with a first discharge pipe (not shown) to guide, to the tube 120, the condensed water having cooled the compressor 165 by passing through the first water jacket 310.

Meanwhile, the first supply pipe 316 is provided with a first condensed water pump 330 to forcibly move the condensed water stored in the condensed water sump 201 of the heat exchanger 200 to the first water jacket 310. In addition, provided between the first condensed water pump 330 and the first water inlet 312 is a first 3-way valve 320 to supply the condensed water stored in the condensed water sump 201 to the first water jacket 310 or to guide the condensed water to the tub 120 to discharge the condensed water.

Herein, the first 3-way valve 320 is provided with a separate solenoid (not shown) that is controlled by the controller (not shown) of the laundry machine 100. The first 3-way valve 320 selectively controls the movement path of the condensed water to be switched to the first water jacket 310 or the tub 120 through operation of the solenoid.

Hereinafter, operation of the first cooling unit 300 according to the first embodiment will be described. As described above, as the heat pump operates to implement the drying operation of the laundry machine 100, the compressor 165 of the heat pump operates, and the laundry is dried with. At the same time, the moisture produced through drying of the laundry is condensed in the evaporator 220 of the heat pump, and the condensed water is collected in the condensed water sump 201 which is at the lower portion of the heat exchanger 200 where the evaporator 220 is positioned.

In this process, the controller determines whether the compressor 165 is overheated by sensing the temperature of the temperature sensor 161 of the air supply unit 160 or the discharge temperature sensor 161 of the heat pump. If overheating of the compressor 165 is sensed, the condensed water is supplied to the first cooling unit 300 to cool the compressor 165.

Specifically, when it is sensed that the compressor 165 is overheated, the controller controls the solenoid driving the first 3-way valve 320 to open the flow passage of the first 3-way valve 320 such that the condensed water sump 201 communicates with the first water inlet 312 of the first water jacket 310.

Thereafter, the first condensed water pump 330 is operated to supply the condensed water collected in the condensed water sump 201 of the heat exchanger 200 to the first water jacket 310 through the first water inlet 312. As the condensed water supplied by the first condensed water pump 330 passes through the first water jacket 310, it cools the upper portion of the compressor 165.

Herein, the condensed water having cooled the compressor 165 by passing through the first water jacket 310 is discharged to the tub 120 through the first discharge pipe. The condensed water discharged to the tub 120 is drained by the drainage sump 124 and the drainage unit 126 provided to the tub 120.

In the case in which the temperature sensor 161 of the air supply unit 160 or the discharge temperature sensor 161 of the heat pump does not senses that the compressor 165 is overheated in the above process, the controller controls the solenoid to maintain the flow passage of the first 3-way valve 320 such that the condensed water sump 201 communicates with the tub 120. Thereby, the condensed water collected in the condensed water sump 201 of the heat exchanger 200 may be discharged to the tub 120.

Hereinafter, a detailed description will be given of a second cooling unit 400 according to a second embodiment of the invention. FIG. 8 is a view schematically illustrating a cooling structure of a compressor according to the second embodiment of the present invention.

As shown in FIG. 8, the second cooling unit 400 according to the second embodiment is provided with a second water jacket 410 defining, on the lower surface of the compressor 165, a space allowing the condensed water to flow therethrough such that the compressor 165 is cooled by the supplied condensed water.

The second water jacket 410 includes a second water inlet 412 connected to the condensed water sump 201 of the heat exchanger 200 to receive the condensed water collected in the condensed water sump 201 and a second water outlet 414 to discharge the condensed water having cooled the compressor 165 by passing through the second water jacket 410.

Herein, the second water inlet 412 is provided with a second supply pipe 416 connected to the condensed water sump 201 to guide the condensed water collected in the condensed water sump 201 to the second water inlet 412. The second water outlet 414 is provided with a second discharge pipe (not shown) to guide, to the tube 120, the condensed water having cooled the compressor 165 by passing through the second water jacket 410.

Meanwhile, the second supply pipe 416 is provided with a second condensed water pump 430 to forcibly move the condensed water stored in the condensed water sump 201 of the heat exchanger 200 to the second water jacket 410. In addition, provided between the second condensed water pump 430 and the second water inlet 412 is a second 3-way valve 420 to supply the condensed water stored in the condensed water sump 201 to the second water jacket 410 or to guide the condensed water to the tub 120 to discharge the condensed water.

Herein, the second 3-way valve 420 is provided with a separate solenoid (not shown) that is controlled by the controller (not shown) of the laundry machine 100. The second 3-way valve 420 selectively controls the movement path of the condensed water to be switched to the first water jacket 310 or the tub 120 through operation of the solenoid The controller determines whether the compressor 165 is overheated by sensing the temperature of the temperature sensor 161 of the air supply unit 160 or the discharge temperature sensor 161 of the heat pump. If it is sensed that the compressor 165 is overheated, the condensed water is supplied to the second cooling unit 400 to cool the compressor 165.

Hereinafter, operation of the second cooling unit 400 according to the second embodiment will be described. As described above, as the heat pump operates to implement the drying operation of the laundry machine 100, the compressor 165 of the heat pump operates, and the laundry is dried with. At the same time, the moisture produced through drying of the laundry is condensed in the evaporator 220 of the heat pump, and the condensed water is collected in the condensed water sump 201 which is at the lower portion of the heat exchanger 200 where the evaporator 220 is positioned.

In this process, the controller determines whether the compressor 165 is overheated by sensing the temperature of the temperature sensor 161 of the air supply unit 160 or the discharge temperature sensor 161 of the heat pump. If overheating of the compressor 165 is sensed, the condensed water is supplied to the second cooling unit 400 to cool the compressor 165.

Specifically, when it is sensed that the compressor 165 is overheated, the controller controls the solenoid driving the second 3-way valve 420 to open the flow passage of the second 3-way valve 420 such that the condensed water sump 201 communicates with the second water inlet 412 of the second water jacket 410.

Thereafter, the second condensed water pump 430 is operated to supply the condensed water collected in the condensed water sump 201 of the heat exchanger 200 to the second water jacket 410 through the second water inlet 412. As the condensed water supplied by the second condensed water pump 430 passes through the second water jacket 410, it cools the compressor 165.

Herein, the condensed water having cooled the compressor 165 by passing through the second water jacket 410 is discharged to the tub 120 through the second discharge pipe. The condensed water discharged to the tub 120 is drained by the drainage sump 124 and the drainage unit 126 provided to the tub 120.

In the case in which the temperature sensor 161 of the air supply unit 160 or the discharge temperature sensor 161 of the heat pump does not senses that the compressor 165 is overheated in the above process, the controller controls the solenoid to maintain the flow passage of the second 3-way valve 420 such that the condensed water sump 201 communicates with the tub 120. Thereby, the condensed water collected in the condensed water sump 201 of the heat exchanger 200 may be discharged to the tub 120.

Hereinafter, a detailed description will be given of a third cooling unit 500 according to a third embodiment of the invention with reference to FIG. 9. FIG. 9 is a view schematically illustrating a cooling structure of a compressor according to the third embodiment of the present invention.

As shown in FIG. 9, the third cooling unit 500 according to the third embodiment is provided with a third water jacket 510 defining, on the lower surface of the compressor 165, a space allowing the condensed water to flow therethrough such that the compressor 165 is cooled by the supplied condensed water, and a washing nozzle 515 to wash the evaporator 220 of the heat pump using the condensed water having passed through the third water jacket 510.

The third water jacket 510 includes a third water inlet 512 connected to the condensed water sump 201 of the heat exchanger 200 to receive the condensed water collected in the condensed water sump 201 and a third flow outlet 514 to discharge the condensed water having cooled the compressor 165 by passing through the third water jacket 510.

Herein, the third water inlet 512 is provided with a third supply pipe 516 connected to the condensed water sump 201 to guide the condensed water collected in the condensed water sump 201 to the third water inlet 512. The third flow outlet 514 is provided with a third discharge pipe 518 to discharge the condensed water having cooled the compressor 165 by passing through the third water jacket 510.

Meanwhile, the third supply pipe 516 is provided with a third condensed water pump 530 to forcibly move the condensed water stored in the condensed water sump 201 of the heat exchanger 200 to the third water jacket 510.

In addition, the third discharge pipe 518 is provided with a third 3-way valve 520 to control the path of the condensed water to discharge the condensed water having passed through the third water jacket 510 or to wash the evaporator 220 of the heat exchanger 200 using the condensed water.

Herein, the third 3-way valve 520 is provided with a separate solenoid (not shown) that is controlled by the controller (not shown) of the laundry machine 100. The third 3-way valve 520 selectively controls the movement path of the condensed water to be switched to the washing nozzle 515 or the tub 120 through operation of the solenoid.

In addition, the washing nozzle 515 is provided to the interior of the heat exchanger 200 and is connected to the third discharge pipe 518 passing through the heat exchanger 200. The washing nozzle 515 is positioned at the front end or rear end of the evaporator 200 or the condenser 240 to spray the condensed water to the evaporator 220 or the condenser 240.

Herein, the washing nozzle 515 is preferably positioned at the front end or rear end of the evaporator 220 or the condenser 240 and arranged to spray the condensed water toward the heat dissipation fins of the evaporator 220 or the condenser 240 to wash the heat dissipation fins of the evaporator 220 and the condenser 240.

The controller of the laundry machine 100 determines whether the compressor 165 is overheated by sensing the temperature of the temperature sensor 161 of the air supply unit 160 or the discharge temperature sensor 161 of the heat pump. If overheating of the compressor 165 is sensed, the controller supplies the condensed water to the third cooling unit 500 to cool the compressor 165. In addition, the controller controls the third 3-way valve 520 to wash the evaporator 220 or the condenser 240 with the washing nozzle 515 using the condensed water at the time of cooling of the compressor 165 or according to a set time to discharge the condensed water having cooled the compressor 165.

Hereinafter, operation of the third cooling unit 500 according to the third embodiment will be described. As described above, as the heat pump operates to implement the drying operation of the laundry machine 100, the compressor 165 of the heat pump operates, and the laundry is dried with. At the same time, the moisture produced through drying of the laundry is condensed in the evaporator 220 of the heat pump, and the condensed water is collected in the condensed water sump 201 which is at the lower portion of the heat exchanger 200 where the evaporator 220 is positioned In addition, the evaporator 220 and the condenser 240 of the heat pump are provided with multiple overlapping heat dissipation fins, and the air moved by the air supply unit 160 contains fine lint. Accordingly, when the air moved by the air supply unit 160 passes through the evaporator 220 and the condenser 240, the lint contained in the air may attach to the heat dissipation fins of the evaporator 220 and condenser 240. To maintain the efficiency of the evaporator 220 and condenser 240, the heat dissipation fins of the evaporator 220 and condenser 240 need to be periodically washed.

While the laundry is dried, the controller determines whether the compressor 165 is overheated by sensing the temperature of the temperature sensor 161 of the air supply unit 160 or the discharge temperature sensor 161 of the heat pump. If overheating of the compressor 165 is sensed, the condensed water is supplied to the third cooling unit 500 to cool the compressor 165.

Specifically, when it is sensed that the compressor 165 is overheated, the controller drives the third condensed water pump 530 to supply the condensed water collected in the condensed water sump 201 of the heat exchanger 200 to the third water jacket 510. Thereby, the condensed water cools the compressor 165 while passing through the third water jacket 510, and is then discharged to the third flow outlet 514.

Herein, the third discharge pipe 518 connected to the third flow outlet 514 is provided with a third 3-way valve 52. The third 3-way valve 520 controls the flow passage of the condensed water to be switched to the washing nozzle 515 or the tub 120 according to control of the solenoid by the controller.

That is, the controller may control the third 3-way valve 520 to connect the third flow outlet 514 and the tub 120 such that the condensed water having passed through the third water jacket 510 is discharged to the tub 120. In addition, in the case in which the evaporator 220 or the condenser 240 needs to be washed, the controller may control the third 3-way valve 520 to connect the third flow outlet 514 and the washing nozzle 515 such that the condensed water is supplied to the washing nozzle 515. Thereby, the evaporator 220 or the condenser 240 may be washed.

In the first to third embodiments, each water jacket 300, 400, 500 is selectively provided to the upper or lower portion of the compressor 165 to cool the compressor 165. In another embodiment, however, a separate water jacket may be additionally provided to the lower or upper portion of the compressor to cool the upper and lower portions of the compressor simultaneously.

In addition, while the compressor 165 is illustrated in the embodiments of the present invention as being cooled using the condensed water produced in the evaporator 220 of the heat pump, the compressor 165 may also be cooled by supplying the cooling water to the respective water jackets 300, 400 and 500 through a separate cooling water supply source (e.g., a wash water supply source).

Various embodiments have been described in the best mode for carrying out the invention.

INDUSTRIAL APPLICABILITY

According to one embodiment of the present invention, a laundry machine using an air supply unit employing a heat pump may have a reduced volume and a compact size.

In addition, with a laundry machine using an air supply unit employing a heat pump according to one embodiment of the present invention, the air supply structure and the air heating structure may be improved.

In addition, with a laundry machine using an air supply unit employing a heat pump according to one embodiment of the present invention, the air movement path in a heat exchanger of the heat pump may be improved, thereby increasing heat exchange efficiency.

With a laundry machine using an air supply unit employing a heat pump according to one embodiment of the present invention, a heat exchanger is integrated with the air supply unit, thereby increasing the heat exchange efficiency of the heat exchanger.

In a laundry machine according to one embodiment of the present invention, when the heat pump overheats during operation, it is directly cooled using cooling water. Therefore, the efficiency of operation of the heat pump may be held constant.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry machine comprising:

a cabinet having a laundry opening;

a tub provided in the cabinet and configured to receive laundry therein through the laundry opening, and the tub to have a cylindrical shape;

an air supply unit that circulates air through the tub, the air supply unit including:

a suction duct that guides interior air from the tub into the air supply unit, a discharge duct that discharges air from the air supply unit back into the tub, a connection duct for connecting the suction duct and the discharge duct, an air-blowing fan provided between the connection duct and the discharge duct to circulate the interior air of the tub through the air supply unit;

a heat pump including:

an evaporator provided at an inside of the connection duct to dehumidify air, a condenser provided at an inside of the connection duct to heat air received from the evaporator, and a compressor provided at an outside of the connection duct and connected to the evaporator and the condenser by a refrigerant pipe; and a cooling unit installed at the compressor to cool the compressor using condensed water generated at the condenser, wherein the cooling unit includes:

a water jacket disposed at an upper portion or a lower portion of the compressor to form a flow passage through which the condensed water moves to cool the compressor, a supply pipe connected to a lower portion of the water jacket for supplying condensed water generated in the evaporator to the water jacket, and a discharge pipe connected to the water jacket to an upper side of the supply pipe for discharging the condensed water passing through the water jacket, wherein the air supply unit is fixed to an upper portion of a circumferential surface of the tub and extends in a diagonal direction across the upper portion of the tub, and wherein the compressor is provided above the tub, at a space between the air supply unit and the cabinet.

2. The laundry machine according to claim 1, wherein a lower portion of the evaporator is provided with a condensed water sump to collect condensed water produced in the evaporator.

3. The laundry machine according to claim 1, wherein the supply pipe is provided with a condensed water pump to forcibly move the condensed water.

4. The laundry machine according to claim 1, wherein a 3-way valve is provided at the supply pipe to switch a flow passage of the condensed water to the water jacket or the tub.

5. The laundry machine according to claim 1, further comprising a washing nozzle provided in the connection duct to wash the evaporator or the condenser, and the discharge pipe supplies the condensed water to the washing nozzle.

6. The laundry machine according to claim 5, wherein a 3-way valve is provided at the discharge pipe to switch a flow passage of the discharge pipe to the washing nozzle or the tub.

7. The laundry machine according to claim 5, wherein supply of the condensed water to the washing nozzle and cooling of the compressor are simultaneously performed.

8. A laundry machine comprising:

a cabinet having a laundry opening;

a tub provided in the cabinet and configured to receive laundry therein through the laundry opening, and the tub to have a cylindrical shape;

an air supply unit that circulates air through the tub, the air supply unit including a connection duct, and an air-blowing fan to circulate interior air of the tub through the air supply unit;

a heat pump including:

an evaporator, at the connection duct, to dehumidify air, a condenser, at the connection duct, to heat air received from the evaporator, and a compressor at an outside of the connection duct and connected to the evaporator and the condenser by at least one refrigerant pipe; and a cooling unit to cool the compressor using condensed water from the condenser, wherein the cooling unit includes:

a water jacket disposed at an upper, portion or a lower portion of the compressor to form a flow passage through which the condensed water moves to cool the compressor, a supply pipe connected to a lower portion of the water jacket for supplying condensed water generated in the evaporator to the water jacket, and a discharge pipe connected to the water jacket to a upper side of the supply pipe for discharging the condensed water passing through the water jacket, wherein the air supply unit is fixed to an upper portion of a circumferential surface of the tub and extends in a diagonal direction across the upper portion of the tub, and wherein the compressor is provided above the tub, at a space between the air supply unit and the cabinet.

9. The laundry machine according to claim 8, wherein the air supply unit includes:

a suction duct that guides the interior air from the tub into the air supply unit, a discharge duct that discharges air from the air supply unit back into the tub, wherein the connection duct connects the suction duct and the discharge duct.

10. The laundry machine according to claim 9, wherein the air-blowing fan is between the connection duct and the discharge duct.

11. The laundry machine according to claim 8, wherein a lower portion of the evaporator is provided with a condensed water sump to collect condensed water produced in the evaporator.

12. The laundry machine according to claim 8, wherein the supply pipe is provided with a condensed water pump to forcibly move the condensed water.

13. The laundry machine according to claim 8, wherein a 3-way valve is provided to change a flow passage of the condensed water to the water jacket or the tub.

14. The laundry machine according to claim 8, wherein a washing nozzle is to wash the evaporator or the condenser, and the discharge pipe is to supply the condensed water to the washing nozzle.

15. The laundry machine according to claim 14, wherein a 3-way valve is to change a flow passage of the discharge pipe to the washing nozzle or the tub.

* * * * *